US010283025B2

(12) United States Patent
Jung et al.

(10) Patent No.: US 10,283,025 B2
(45) Date of Patent: May 7, 2019

(54) DISPLAY PANEL INSPECTING APPARATUS AND DISPLAY DEVICE INCLUDING THE SAME

(71) Applicant: Samsung Display Co., Ltd., Yongin, Gyeonggi-Do (KR)

(72) Inventors: Young-Taeg Jung, Busan (KR); Chae-Han Hyun, Cheonan-si (KR); Jung-Hun Yi, Gimcheon-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 861 days.

(21) Appl. No.: 14/807,717

(22) Filed: Jul. 23, 2015

(65) Prior Publication Data

US 2016/0225300 A1 Aug. 4, 2016

(30) Foreign Application Priority Data

Jan. 30, 2015 (KR) ..... 10-2015-0015420

(51) Int. Cl.
*G09G 3/00* (2006.01)
*G09G 3/20* (2006.01)

(52) U.S. Cl.
CPC ..... *G09G 3/006* (2013.01)

(58) Field of Classification Search
None
See application file for complete search history.

(56) References Cited

U.S. PATENT DOCUMENTS

2011/0043500 A1* 2/2011 Kwak ..... G09G 3/006 345/206
2013/0141314 A1* 6/2013 Ka ..... G09G 3/006 345/55
2013/0161631 A1* 6/2013 Lee ..... H01L 29/66765 257/71
2014/0098143 A1 4/2014 Lee et al.
2014/0240521 A1* 8/2014 Kwak ..... H04N 17/004 348/189

(Continued)

FOREIGN PATENT DOCUMENTS

KR 10-2011-0032328 A 3/2011
KR 10-2011-0034871 A 4/2011

(Continued)

*Primary Examiner* — Kent W Chang
*Assistant Examiner* — Benjamin Morales
(74) *Attorney, Agent, or Firm* — F. Chau & Associates, LLC

(57) ABSTRACT

A display panel inspecting apparatus and a display device including the same are disclosed. In one aspect, display panel inspecting apparatus includes a first inspecting circuit configured to alternately apply a first-color data signal and a second-color data signal to a first data line electrically connected to a first first-color subpixel and a first second-color subpixel. The apparatus also includes a second inspecting circuit configured to apply a first third-color data signal to a second data line electrically connected to a first third-color subpixel and a second third-color subpixel. The apparatus further includes a third inspecting circuit configured to alternately apply the second-color data signal and the first-color data signal to a third data line electrically connected to a second second-color subpixel and a second first-color subpixel.

20 Claims, 3 Drawing Sheets

(56) References Cited

U.S. PATENT DOCUMENTS

| | | | | |
|---|---|---|---|---|
| 2014/0354285 | A1* | 12/2014 | Kim | G09G 3/3233<br>324/414 |
| 2014/0354286 | A1* | 12/2014 | Kim | G09G 3/006<br>324/414 |
| 2015/0090961 | A1* | 4/2015 | Lee | H01L 22/30<br>257/40 |

FOREIGN PATENT DOCUMENTS

| | | | |
|---|---|---|---|
| KR | 10-2012-0072816 | A | 7/2012 |
| KR | 10-2013-0017876 | A | 2/2013 |
| KR | 10-2014-0077495 | A | 6/2014 |

* cited by examiner

DISPLAY PANEL INSPECTING APPARATUS AND DISPLAY DEVICE INCLUDING THE SAME

This application claims priority under 35 U.S.C. § 119 to Korean Patent Application No. 10-2015-0015420, filed on Jan. 30, 2015 in the Korean Intellectual Property Office KIPO, the contents of which are herein incorporated by reference in their entireties.

BACKGROUND

Field

The described technology generally relates to an inspecting apparatus for a display panel and a display device including the inspecting apparatus.

Description of the Related Technology

Generally, a display panel inspecting portion is formed in a peripheral area of a display panel to detect defective pixels and short-circuits in lines. In a typical inspecting portion, the lighting-on inspecting portion, which detects whether a pixel can emit light, is formed in a lower portion of the display panel and the short inspecting portion, which detects short-circuited lines, is formed in an upper portion of the display panel. Thus, there can be significant dead space in the display apparatus.

SUMMARY OF CERTAIN INVENTIVE ASPECTS

One inventive aspect relates to an inspecting apparatus for a display panel for improving a reliability of inspection and reducing a dead space of a display device.

Another aspect is a display device including the inspecting apparatus for the display panel.

Another aspect is a display panel inspecting apparatus including a first inspecting signal applying portion, a second inspecting signal applying portion, a third inspecting signal applying portion and a fourth inspecting signal applying portion. The first inspecting signal applying portion is configured to alternately apply a first-color data signal and a second-color data signal to a first data line connected to a first first-color subpixel and a first second-color subpixel. The second inspecting signal applying portion is configured to apply a first third-color data signal to a second data line connected to a first third-color subpixel and a second third-color subpixel. The third inspecting signal applying portion is configured to alternately apply the second-color data signal and the first-color data signal to a third data line connected to a second second-color subpixel and a second first-color subpixel. The fourth inspecting signal applying portion is configured to apply a second third-color data signal to a fourth data line connected to a third third-color subpixel and a fourth third-color subpixel.

In an exemplary embodiment, the first inspecting signal applying portion includes a first switching element and a second switching element. The first switching element can include a control electrode connected to a first gate pad, an input electrode connected to a first data pad and an output electrode connected to the first data line. The second switching element can include a control electrode connected to a second gate pad, an input electrode connected to a second data pad and an output electrode connected to the first data line.

In an exemplary embodiment, the third inspecting signal applying portion includes a fourth switching element and a fifth switching element. The fourth switching element can include a control electrode connected to the first gate pad, an input electrode connected to the second data pad and an output electrode connected to the third data line. The fifth switching element can include a control electrode connected to the second gate pad, an input electrode connected to the first data pad and an output electrode connected to the third data line.

In an exemplary embodiment, the second inspecting signal applying portion includes a third switching element. The third switching element can include a control electrode connected to a third gate pad, an input electrode connected to a third data pad and an output electrode connected to the second data line.

In an exemplary embodiment, the fourth inspecting signal applying portion includes a sixth switching element. The sixth switching element can include a control electrode connected to the third gate pad, an input electrode connected to a fourth data pad and an output electrode connected to the fourth data line.

In an exemplary embodiment, the display panel inspecting apparatus further includes three gate pads to turn on the first to fourth inspecting signal applying portion and four data pads to apply data signals to the first to fourth data lines.

In an exemplary embodiment, a first gate pad and a second gate pad are connected to both of the first inspecting signal applying portion and the third inspecting signal applying portion. A third gate pad can be connected to the second inspecting signal applying portion and the fourth inspecting signal applying portion. A first data pad and a second data pad can be connected to both of the first inspecting signal applying portion and the third inspecting signal applying portion. A third data pad can be connected to the second inspecting signal applying portion. A fourth data pad can be connected to the fourth inspecting signal applying portion.

In an exemplary embodiment, the display panel inspecting apparatus further includes a fifth inspecting signal applying portion configured to apply the first third-color data signal to the fourth data line.

In an exemplary embodiment, the second inspecting signal applying portion includes a third switching element. The third switching element can include a control electrode connected to a third gate pad, an input electrode connected to a third data pad and an output electrode connected to the second data line.

In an exemplary embodiment, the fourth inspecting signal applying portion includes a sixth switching element. The sixth switching element can include a control electrode connected to a fourth gate pad, an input electrode connected to a fourth data pad and an output electrode connected to the fourth data line.

In an exemplary embodiment, the fifth inspecting signal applying portion includes a seventh switching element. The seventh switching element can include a control electrode connected to a fifth gate pad, an input electrode connected to the third data pad and an output electrode connected to the fourth data line.

Another aspect is a display device that includes a display panel and a display panel inspecting portion. The display panel includes a first data line connected to a first first-color subpixel and a first second-color subpixel, a second data line connected to a first third-color subpixel and a second third-color subpixel, a third data line connected to a second second-color subpixel and a second first-color subpixel and a fourth data line connected to a third third-color subpixel and a fourth third-color subpixel. The display panel inspecting portion includes a first inspecting signal applying portion configured to alternately apply a first-color data signal and a second-color data signal to the first data line, a second inspecting signal applying portion configured to apply a first third-color data signal to the second data line, a third inspecting signal applying portion configured to alternately apply the second-color data signal and the first-color data signal to the third data line and a fourth inspecting signal applying portion configured to apply a second third-color data signal to the fourth data line.

In an exemplary embodiment, the first inspecting signal applying portion includes a first switching element and a second switching element. The first switching element can include a control electrode connected to a first gate pad, an input electrode connected to a first data pad and an output electrode connected to the first data line. The second switching element can include a control electrode connected to a second gate pad, an input electrode connected to a second data pad and an output electrode connected to the first data line.

In an exemplary embodiment, the third inspecting signal applying portion includes a fourth switching element and a fifth switching element. The fourth switching element can include a control electrode connected to the first gate pad, an input electrode connected to the second data pad and an output electrode connected to the third data line. The fifth switching element can include a control electrode connected to the second gate pad, an input electrode connected to the first data pad and an output electrode connected to the third data line.

In an exemplary embodiment, the second inspecting signal applying portion includes a third switching element. The third switching element can include a control electrode connected to a third gate pad, an input electrode connected to a third data pad and an output electrode connected to the second data line.

In an exemplary embodiment, the fourth inspecting signal applying portion includes a sixth switching element. The sixth switching element can include a control electrode connected to the third gate pad, an input electrode connected to a fourth data pad and an output electrode connected to the fourth data line.

In an exemplary embodiment, the display panel inspecting portion further includes a fifth inspecting signal applying portion configured to apply the first third-color data signal to the fourth data line.

In an exemplary embodiment, the display panel includes a subpixel repeating group. The subpixel repeating group can include a first red subpixel, a first green subpixel adjacent to the first red subpixel in a first direction, a second blue subpixel adjacent to the first green subpixel in the first direction, a third green subpixel adjacent to the second blue subpixel in the first direction, a first blue subpixel adjacent to the first red subpixel in a second direction, a second green subpixel adjacent to the first blue subpixel in the first direction, a second red subpixel adjacent to the second green subpixel in the first direction and a fourth green subpixel adjacent to the second red subpixel in the first direction. The first red subpixel, the first green subpixel, the first blue subpixel and the second green subpixel can form a first pixel. The second blue subpixel, the third green subpixel, the second red subpixel and the fourth green subpixel can form a second pixel.

In an exemplary embodiment, the first data line and the third data line are formed on a first metal layer. The second data line and the fourth data line can be formed on a second metal layer.

In an exemplary embodiment, the display device further includes a gate driver configured to apply a gate signal to the subpixels and a data driver configured to apply a grayscale voltage to the subpixels. The display panel inspecting portion can overlap the data driver.

Another aspect is a display panel inspecting apparatus comprising: a first inspecting circuit configured to alternately apply a first-color data signal and a second-color data signal to a first data line electrically connected to a first first-color subpixel and a first second-color subpixel; a second inspecting circuit configured to apply a first third-color data signal to a second data line electrically connected to a first third-color subpixel and a second third-color subpixel; a third inspecting circuit configured to alternately apply the second-color data signal and the first-color data signal to a third data line electrically connected to a second second-color subpixel and a second first-color subpixel; and a fourth inspecting circuit configured to apply a second third-color data signal to a fourth data line electrically connected to a third third-color subpixel and a fourth third-color subpixel.

In the above display panel inspecting apparatus, the first inspecting circuit comprises first and second switching elements, wherein the first switching element comprises a control electrode electrically connected to a first gate pad, an input electrode electrically connected to a first data pad and an output electrode electrically connected to the first data line, and wherein the second switching element comprises a control electrode electrically connected to a second gate pad, an input electrode electrically connected to a second data pad and an output electrode electrically connected to the first data line.

In the above display panel inspecting apparatus, the third inspecting circuit comprises fourth and fifth switching elements, wherein the fourth switching element comprises a control electrode electrically connected to the first gate pad, an input electrode electrically connected to the second data pad and an output electrode electrically connected to the third data line, and wherein the fifth switching element comprises a control electrode electrically connected to the second gate pad, an input electrode electrically connected to the first data pad and an output electrode electrically connected to the third data line.

In the above display panel inspecting apparatus, the second inspecting circuit comprises a third switching element, wherein the third switching element comprises a control electrode electrically connected to a third gate pad, an input electrode electrically connected to a third data pad and an output electrode electrically connected to the second data line.

In the above display panel inspecting apparatus, the fourth inspecting circuit comprises a sixth switching element, wherein the sixth switching element comprises a control electrode electrically connected to the third gate pad, an input electrode electrically connected to a fourth data pad and an output electrode electrically connected to the fourth data line.

The above display panel inspecting apparatus further comprises: three gate pads each configured to turn on one or more of the first to fourth inspecting circuits; and four data pads each configured to supply a plurality of data signals respectively to the first to fourth data lines.

In the above display panel inspecting apparatus, the gate pads include first to third gate pads, wherein the data pads include first to fourth data pads, wherein the first and second gate pads are electrically connected to both of the first and third inspecting circuits, wherein the third gate pad is electrically connected to the second and fourth inspecting circuits, wherein the first and second data pads are electrically connected to both of the first and third inspecting circuits, wherein the third data pad is electrically connected to the second inspecting circuit, and wherein the fourth data pad is electrically connected to the fourth inspecting circuit.

The above display panel inspecting apparatus further comprising a fifth inspecting circuit configured to apply the first third-color data signal to the fourth data line.

In the above display panel inspecting apparatus, the data pads include first to third data pads, wherein the gate pads include first to fourth gate pads, wherein the display panel inspecting apparatus further comprises first to third switching elements, wherein the second inspecting circuit comprises the third switching element, and wherein the third switching element comprises a control electrode electrically connected to the third gate pad, an input electrode electrically connected to the third data pad and an output electrode electrically connected to the second data line.

The above display panel inspecting apparatus further comprises fourth to sixth switching elements, wherein the fourth inspecting circuit comprises the sixth switching element, wherein the sixth switching element comprises a control electrode electrically connected to the fourth gate pad, an input electrode electrically connected to the fourth data pad and an output electrode electrically connected to the fourth data line.

The above display panel inspecting apparatus further comprises a fifth gate pad, wherein the fifth inspecting circuit comprises a seventh switching element, and wherein the seventh switching element comprises a control electrode electrically connected to the fifth gate pad, an input electrode electrically connected to the third data pad and an output electrode electrically connected to the fourth data line.

Another aspect is a display device comprising: a display panel comprising i) a first data line electrically connected to a first first-color subpixel and a first second-color subpixel, ii) a second data line electrically connected to a first third-color subpixel and a second third-color subpixel, iii) a third data line electrically connected to a second second-color subpixel and a second first-color subpixel and iv) a fourth data line electrically connected to a third third-color subpixel and a fourth third-color subpixel; and a display panel inspecting apparatus comprising i) a first inspecting circuit configured to alternately apply a first-color data signal and a second-color data signal to the first data line, ii) a second inspecting circuit configured to apply a first third-color data signal to the second data line, iii) a third inspecting circuit configured to alternately apply the second-color data signal and the first-color data signal to the third data line, and iv) a fourth inspecting circuit configured to apply a second third-color data signal to the fourth data line.

In the above display device, the first inspecting circuit comprises first and second switching elements, wherein the first switching element comprises a control electrode electrically connected to a first gate pad, an input electrode electrically connected to a first data pad and an output electrode electrically connected to the first data line, and wherein the second switching element comprises a control electrode electrically connected to a second gate pad, an input electrode electrically connected to a second data pad and an output electrode electrically connected to the first data line.

In the above display device, the third inspecting circuit comprises fourth and fifth switching elements, wherein the fourth switching element comprises a control electrode electrically connected to the first gate pad, an input electrode electrically connected to the second data pad and an output electrode electrically connected to the third data line, and wherein the fifth switching element comprises a control electrode electrically connected to the second gate pad, an input electrode electrically connected to the first data pad and an output electrode electrically connected to the third data line.

In the above display device, the second inspecting circuit comprises a third switching element, wherein the third switching element comprises a control electrode electrically connected to a third gate pad, an input electrode electrically connected to a third data pad and an output electrode electrically connected to the second data line.

In the above display device, the fourth inspecting circuit comprises a sixth switching element, wherein the sixth switching element comprises a control electrode electrically connected to the third gate pad, an input electrode electrically connected to a fourth data pad and an output electrode electrically connected to the fourth data line.

In the above display device, the display panel inspecting apparatus further comprises a fifth inspecting circuit configured to apply the first third-color data signal to the fourth data line.

In the above display device, the display panel comprises a subpixel group comprising: a first red subpixel; a first green subpixel adjacent to the first red subpixel in a first direction; a second blue subpixel adjacent to the first green subpixel in the first direction; a third green subpixel adjacent to the second blue subpixel in the first direction; a first blue subpixel adjacent to the first red subpixel in a second direction crossing the first direction; a second green subpixel adjacent to the first blue subpixel in the first direction; a second red subpixel adjacent to the second green subpixel in the first direction; and a fourth green subpixel adjacent to the second red subpixel in the first direction, wherein the first red subpixel, the first green subpixel, the first blue subpixel and the second green subpixel form a first pixel, and wherein the second blue subpixel, the third green subpixel, the second red subpixel and the fourth green subpixel form a second pixel.

In the above display device, the first and third data lines are formed over a first metal layer, wherein the second and fourth data lines are formed over a second metal layer.

The above display device further comprises a gate driver configured to apply a gate signal to the subpixels and a data driver configured to apply a grayscale voltage to the subpixels, wherein the display panel inspecting apparatus overlaps the data driver.

According to at least one of the disclosed embodiments, a lighting-on inspection and a data line short inspection of the display panel can be operated by a single integrated inspecting apparatus. Accordingly, a reliability of the inspection of the display panel can be improved and a dead space of the display device can be reduced.

DETAILED DESCRIPTION OF CERTAIN INVENTIVE EMBODIMENTS

Hereinafter, the described technology will be explained in detail with reference to the accompanying drawings. In this disclosure, the term "substantially" includes the meanings of completely, almost completely or to any significant degree under some applications and in accordance with those skilled in the art. Moreover, "formed on" can also mean "loaned over." The term "connected" can include an electrical connection.

Figure 1:
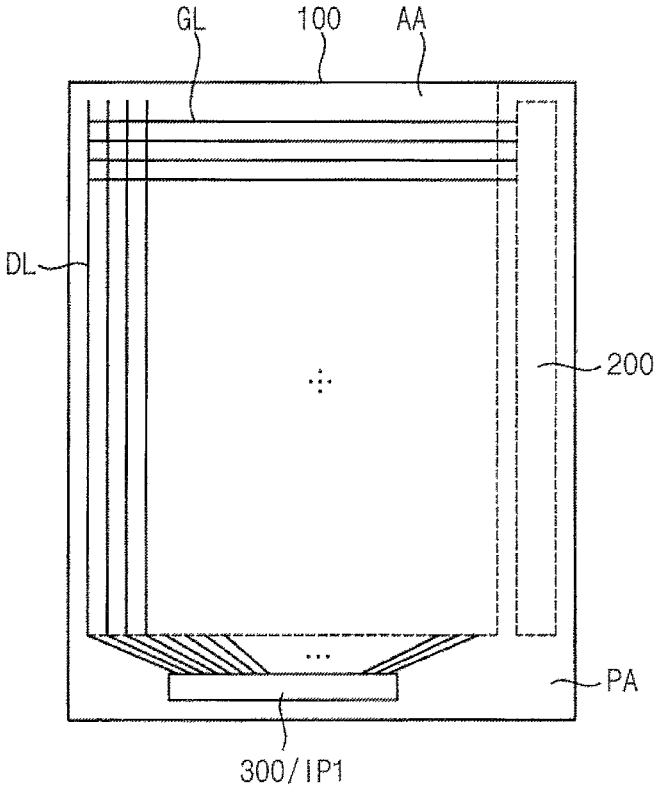
FIG. 1 is a plan view illustrating a display device according to an example embodiment.

Referring to FIG. 1, the display device includes a display panel 100, a display panel inspecting portion IP1 and a display panel driver. The display panel driver includes a gate driver 200 and a data driver 300. The data driver 300 can include a timing controller (not shown). Alternatively, the timing controller can be independently formed separately from the data driver 300.

The display panel 100 includes a display region AA on which an image is displayed and a peripheral region PA adjacent to the display region AA. The peripheral region PA can surround the display region AA. The peripheral region PA can also be called dead space.

The display panel 100 includes a plurality of gate lines GL, a plurality of data lines DL, and a plurality of subpixels electrically connected to the gate lines GL and the data lines DL. The gate lines GL extend in a first direction D1, and the data lines DL extend in a second direction D2 crossing the first direction D1.

Figure 2:
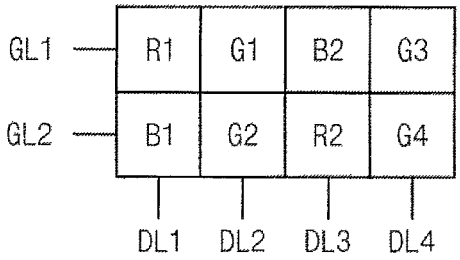
FIG. 2 is a conceptual diagram illustrating a subpixel repeating group of a display panel of FIG. 1.

A pixel structure of the display panel 100 is explained referring to FIG. 2 in detail.

The timing controller receives an input image data and an input control signal from an external device. The input image data can include a red image data, a green image data and a blue image data. The input control signal includes a master clock signal and a data enable signal. The input control signal can further include a vertical synchronizing signal and a horizontal synchronizing signal.

The timing controller generates a first control signal, a second control signal and a data signal based on the input image data and the input control signal.

The timing controller generates the first control signal for controlling driving timing of the gate driver 200 based on the input control signal, and outputs the first control signal to the gate driver 200.

The timing controller generates the second control signal for controlling a driving timing of the data driver 300 based on the input control signal, and outputs the second control signal to the data driver 300.

The timing controller generates the data based on the input image data, and outputs the data signal to the data driver 300.

The gate driver 200 generates gate signals driving the gate lines GL in response to the first control signal received from the timing controller. The gate driver 200 sequentially outputs the gate signals to the gate lines GL.

The gate driver 200 can be integrally formed on the peripheral region PA of the display panel 100. Alternatively, the gate driver 300 can be mounted on the peripheral region PA of the display panel 100, or can be connected to the peripheral region PA of the display panel 100 as a tape carrier package (TCP) type.

The data driver 300 receives the second control signal and the data signal from the timing controller. The data driver 300 converts the data signal into grayscale voltages. The data driver 300 outputs the grayscale voltages to the data lines DL.

The display panel inspecting portion IP1 can overlap the data driver 300. For example, the display panel inspecting portion IP1 is integrally formed in the peripheral region PA of the display panel 100. The data driver 300 can be mounted as a chip type on a position where the display panel inspecting portion IP1 is formed.

The display panel inspecting portion IP1 can determine whether pixels of the display panel 100 normally display the image. For example, the pixels of the display panel 100 are inspected whether the pixels of the display panel 100 normally display the image or not using the display panel inspecting portion IP1 before mounting the data driver 300 on the display panel 100.

When the inspection of the display panel 100 finishes, the display panel inspecting portion IP1 can be disconnected from the data lines DL. For example, a switching portion is formed that connects or disconnects the display panel inspecting portion IP1 to and from the data lines DL.

For example, the display panel inspecting portion IP1 operates the pixel lighting-on inspection. For example, the display panel inspecting portion IP1 operates the short inspection of the data lines DL.

In the pixel lighting-on inspection, the pixels of the display panel 100 displays a specific image and an inspecting person checks whether a pixel that is not turned on exists or not. For example, the display panel 100 displays a single color image during the pixel lighting-on inspection. The single color image can be one of a red image, a green image, a blue image, a black image and a white image. Alternatively, the display panel 100 can display a stripe pattern image, a checker board pattern image and a gradation image during the pixel lighting-on inspection.

In the short inspection of the data lines DL, the display panel 100 displays a vertical stripe pattern image and whether a short exists between adjacent data lines is determined. For example, when a high grayscale is applied to a first data line and a low grayscale is applied to a second data line adjacent to the first data line, subpixels connected to the first data line represent high luminance and subpixels connected to the second data line represent low luminance. However, when the first data line and the second data line are shorted, the subpixels connected to the first data line and the second data line can partially or totally represent the same grayscale.

When the data lines are formed on the same metal layer, different grayscales can be applied to the first data line and the second data line which is adjacent to the first data line to operate the short inspection between the first and second data lines.

Alternatively, when data lines of a first group are formed on a first metal layer and data lines of a second group are formed on a second metal layer, different grayscales can be applied to adjacent data lines in the first group to operate the short inspection between the data lines in the second group and different grayscales can be applied to adjacent data lines in the second group to operate the short inspection between the data lines in the second group.

Figure 4:
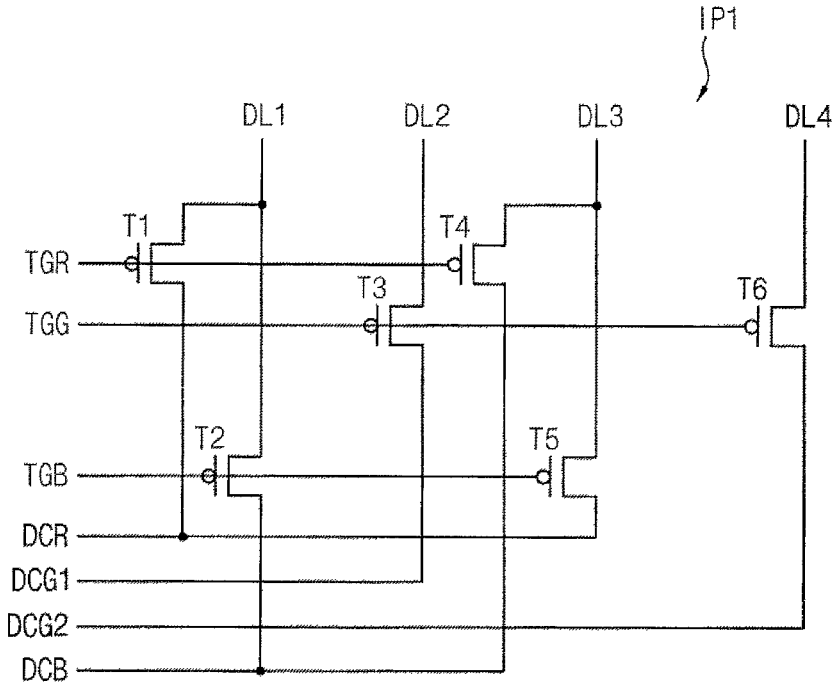
FIG. 4 is a circuit diagram illustrating a display panel inspecting portion of FIG. 1.

The structure and the operation of the display panel inspecting portion IP1 are explained referring to FIG. 4.

Figure 3:
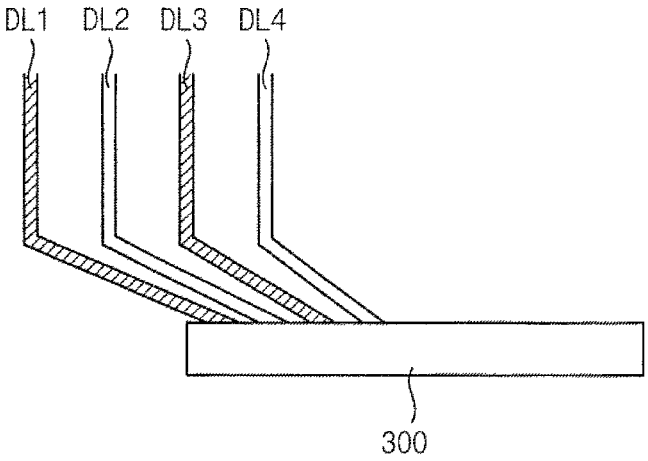
FIG. 3 is a conceptual diagram illustrating a data driver and data lines of FIG. 1.

FIG. 2 is a conceptual diagram illustrating a subpixel repeating group of a display panel 100 of FIG. 1. FIG. 3 is a conceptual diagram illustrating the data driver 300 and the data lines DL of FIG. 1. FIG. 4 is a circuit diagram illustrating a display panel inspecting portion IP1 of FIG. 1.

Referring to FIGS. 1 to 4, the display panel 100 includes a PenTile pixel structure. The display panel 100 can include a plurality of subpixel repeating groups. The subpixel repeating groups are repeated in a first direction and a second direction.

The display panel 100 includes a first data line DL1, a second data line DL2, a third data line DL3 and a fourth data line DL4. The first line DL1 is connected to a first first-color subpixel R1 and a first second-color subpixel B1. The second data line DL2 is connected to a first third-color subpixel G1 and a second third-color subpixel G2. The third data line DL3 is connected to a second second-color subpixel B2 and a second first-color subpixel R2. The fourth data line DL4 is connected to a third third-color subpixel G3 and a fourth third-color subpixel G4.

For example, the first-color is red, the second-color is blue and the third-color is green.

The subpixel repeating group includes a first red subpixel R1, a first green subpixel G1 which is adjacent to the first red subpixel R1 in the first direction, a second blue subpixel B2 which is adjacent to the first green subpixel G1 in the first direction and a third green subpixel G3 which is adjacent to the second green subpixel B2 in the first direction. The subpixel repeating group also includes a first blue subpixel B1 which is adjacent to the first red subpixel R1 in the second direction, a second green subpixel G2 which is adjacent to the first blue subpixel B1 in the first direction, a second red subpixel R2 which is adjacent to the second green subpixel G2 in the first direction and a fourth green subpixel G4 which is adjacent to the second red subpixel R2 in the first direction.

The first red subpixel R1, the first green subpixel G1, the first blue subpixel B1 and the second green subpixel G2 can form a first pixel. The second blue subpixel B2, the third green subpixel G3, the second red subpixel R2 and the fourth green subpixel G4 can form a second pixel.

The display panel inspecting portion IP1 can include a first inspecting signal applying portion which applies a first-color data signal and a second-color data signal to the first data line DL1, a second inspecting signal applying portion which applies a first third-color data signal to the second data line DL2, a third inspecting signal applying portion which applies the second-color data signal and the first-color data signal to the third data line DL3 and a fourth inspecting signal applying portion which applies a second third-color data signal to the fourth data line DL4.

Although not shown in figures, the first inspecting signal applying portion can be commonly connected to the first data line, a fifth data line, a ninth data line and so on. The second inspecting signal applying portion can be commonly connected to the second data line, a sixth data line, a tenth data line and so on. The third inspecting signal applying portion can be commonly connected to the third data line, a seventh data line, an eleventh data line and so on. The fourth inspecting signal applying portion can be commonly connected to the fourth data line, an eighth data line, a twelfth data line and so on.

The first inspecting signal applying portion can include a first switching element T1 and a second switching element T2.

The first switching element T1 includes a control electrode connected to a first gate pad TGR, an input electrode connected to a first data pad DCR and an output electrode connected to the first data line DL1. The first data pad DCR can apply a red data signal to the first data line DL1.

The second switching element T2 includes a control electrode connected to a second gate pad TGB, an input electrode connected to a second data pad DCB and an output electrode connected to the first data line DL1. The second data pad DCB can apply a blue data signal to the first data line DL1.

The second inspecting signal applying portion can include a third switching element T3.

The third switching element T3 includes a control electrode connected to a third gate pad TGG, an input electrode connected to a third data pad DCG1 and an output electrode connected to the second data line DL2. The third data pad DCG1 can apply a first green data signal to the second data line DL2.

The third inspecting signal applying portion can include a fourth switching element T4 and a fifth switching element T5.

The fourth switching element T4 includes a control electrode connected to the first gate pad TGR, an input electrode connected to the second data pad DCB and an output electrode connected to the third data line DL3. The fourth switching element T4 and the first switching element T1 are connected to the gate pad TGR so that the first and fourth switching elements T1 and T4 can be substantially simultaneously or concurrently turned on and off. When the red data signal is applied to the first data line DL1 by the first switching element T1, the blue data signal is applied to the third data line DL3 by the fourth switching element T4.

The fifth switching element T5 includes a control electrode connected to the second gate pad TGB, an input electrode connected to the first data pad DCR and an output electrode connected to the third data line DL3. The fifth switching element T5 and the second switching element T2 are connected to the gate pad TGB so that the second and fifth switching elements T2 and T5 can be substantially simultaneously or concurrently turned on and off. When the blue data signal is applied to the first data line DL1 by the second switching element T2, the red data signal is applied to the third data line DL3 by the fifth switching element T5.

The fourth inspecting signal applying portion can include a sixth switching element T6.

The sixth switching element T6 includes a control electrode connected to the third gate pad TGG, an input electrode connected to a fourth data pad DCG2 and an output electrode connected to the fourth data line DL4. The sixth switching element T6 and the third switching element T3 are connected to the gate pad TGG so that the third and sixth switching elements T3 and T6 can be substantially simultaneously or concurrently turned on and off. When the first green data signal is applied to the second data line DL2 by the third switching element T3, the second green data signal is applied to the fourth data line DL4 by the sixth switching element T6.

In the present exemplary embodiment, the display panel inspecting portion IP1 includes three gate pads TGR, TGB and TGG to turn on the first to fourth inspecting signal applying portion and four data pads DGR, DCB, DCG1 and DCG2 to apply the data signals to the first to fourth data lines DL1 to DL4.

In the present exemplary embodiment, the first data line DL1 and the third data line DL3 is formed on a first metal layer. The second data line DL2 and the fourth data line DL4 can be formed on a second metal layer different from the first layer. The second metal layer can be insulated from the first metal layer by an insulating layer.

Although not shown in figures, a fifth data line, a seventh data line, . . . can be formed on the first metal layer. Although not shown in figures, a sixth data line, an eighth data line, . . . can be formed on the second metal layer.

For the short inspection of the data lines, the different data are applied to the adjacent data lines in the same layer. A typical display panel inspecting portion includes one red data pad, one green data pad and one blue data pad, so that short inspection of the first and third data lines connected to the different data pads (red data pad and blue data pad) is possible but short inspection of the second and fourth data lines connected to the same data pads (green data pad) is impossible. Accordingly, the lighting-on inspecting portion and the short inspecting portion are independently formed so that the dead space of the display device increases.

According to the present exemplary embodiment, the second data line DL2 is connected to the third data pad DCG1 providing the first green data signal and the fourth data line DL4 is connected to the fourth data pad DCG2 providing the second green data signal. Accordingly, the short inspection of the second and fourth data lines DL2 and DL4 is possible.

Thus, the reliable pixel lighting-on inspection and the reliable short inspection of the data lines are operated using the display panel inspecting portion IP1. In addition, the display device include the single integrated display panel inspecting portion IP1 for the pixel lighting-on inspection and the short inspection of the data lines so that the dead space of the display device can be reduced.

Figure 5:
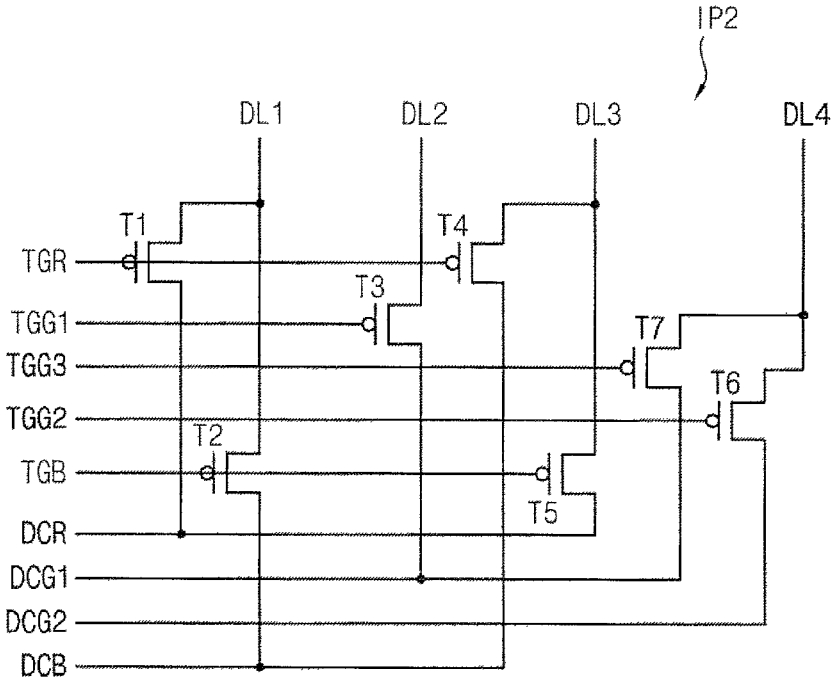
FIG. 5 is a plan view illustrating a circuit diagram illustrating a display panel inspecting portion according to an example embodiment.

FIG. 5 is a plan view illustrating a circuit diagram illustrating a display panel inspecting portion IP2 according to an example embodiment.

The display panel inspecting apparatus and the display device according to the illustrated exemplary embodiment is substantially the same as the display panel inspecting apparatus and the display device explained referring to FIGS. 1 to 4 except for some elements of the display panel inspecting portion. Thus, the same reference numerals will be used to refer to same or like portions as those described in with reference to FIGS. 1 to 4 and any further repetitive explanation concerning the above elements will be omitted.

Referring to FIGS. 1 to 3 and 5, the display device includes a display panel 100, a display panel inspecting portion IP2 and a display panel driver. The display panel driver includes a gate driver 200 and a data driver 300. The data driver 300 can include a timing controller.

The display panel 100 includes a PenTile pixel structure. The display panel 100 can include a plurality of subpixel repeating groups. The subpixel repeating groups are repeated in a first direction and a second direction.

The display panel 100 includes a first data line DL1, a second data line DL2, a third data line DL3 and a fourth data line DL4. The first line DL1 is connected to a first first-color subpixel R1 and a first second-color subpixel B1. The second data line DL2 is connected to a first third-color subpixel G1 and a second third-color subpixel G2. The third data line DL3 is connected to a second second-color subpixel B2 and a second first-color subpixel R2. The fourth data line DL4 is connected to a third third-color subpixel G3 and a fourth third-color subpixel G4.

The display panel inspecting portion IP2 includes a first inspecting signal applying portion which applies a first-color data signal and a second-color data signal to the first data line DL1, a second inspecting signal applying portion which applies a first third-color data signal to the second data line DL2, a third inspecting signal applying portion which applies the second-color data signal and the first-color data signal to the third data line DL3 and a fourth inspecting signal applying portion which applies a second third-color data signal to the fourth data line DL4.

In the present exemplary embodiment, the display panel inspecting portion IP2 further includes a fifth inspecting signal applying portion which applies the first third-color data signal to the fourth data line.

Although not shown in figures, the first inspecting signal applying portion can be commonly connected to the first data line, a fifth data line, a ninth data line and so on. The second inspecting signal applying portion can be commonly connected to the second data line, a sixth data line, a tenth data line and so on. The third inspecting signal applying portion can be commonly connected to the third data line, a seventh data line, an eleventh data line and so on. The fourth inspecting signal applying portion and the fifth inspecting signal applying portion can be commonly connected to the fourth data line, an eighth data line, a twelfth data line and so on.

The second inspecting signal applying portion can include a third switching element T3.

The third switching element T3 includes a control electrode connected to a third gate pad TGG1, an input electrode connected to a third data pad DCG1 and an output electrode connected to the second data line DL2. The third data pad DCG1 can apply a first green data signal to the second data line DL2.

The fourth inspecting signal applying portion can include a sixth switching element T6.

The sixth switching element T6 includes a control electrode connected to a fourth gate pad TGG2, an input electrode connected to a fourth data pad DCG2 and an output electrode connected to the fourth data line DL4.

The fifth inspecting signal applying portion can include a seventh switching element T7.

The seventh switching element T7 includes a control electrode connected to a fifth gate pad TGG3, an input electrode connected to the third data pad DCG1 and an output electrode connected to the fourth data line DL4.

In the present exemplary embodiment, the display panel inspecting portion IP2 includes five gate pads TGR, TGB, TGG1, TGG2 and TGG3 to turn on the first to fifth inspecting signal applying portion and four data pads DCR, DCB, DCG1 and DCG2 to apply the data signals to the first to fourth data lines DL1 to DL4.

When the display panel inspecting portion IP2 operates the pixel lighting-on inspection, the green data voltage applied to the second data line DL2 and green data voltage applied to the fourth data line DL4 can be the same.

Accordingly, when the display panel inspecting portion IP2 operates the pixel lighting-on inspection, the third switching element T3 and the seventh switching element T7 are turned on to apply the first green data signal to the second data line DL2 and the fourth data line DL4.

When the display panel inspecting portion IP2 operates the short inspection of the data lines, the green data voltage applied to the second data line DL2 and green data voltage applied to the fourth data line DL4 can be different from each other.

Accordingly, when the display panel inspecting portion IP2 operates the short inspection of the data lines, the third switching element T3 and the sixth switching element T6 are turned on to apply the first green data signal to the second data line DL2 and the second green data signal to the fourth data line DL4.

According to the present exemplary embodiment, in the short inspection of the data lines, the second data line DL2 is connected to the third data pad DCG1 providing the first green data signal and the fourth data line DL4 is connected to the fourth data pad DCG2 providing the second green data signal. Accordingly, the short inspection of the second and fourth data lines DL2 and DL4 is possible.

Thus, the reliable pixel lighting-on inspection and the reliable short inspection of the data lines are operated using the display panel inspecting portion IP2. In addition, the display device includes the single integrated display panel inspecting portion IP2 for the pixel lighting-on inspection and the short inspection of the data lines so that the dead space of the display device can be reduced.

According to at least one of the disclosed embodiments, the display panel inspection is more reliable. In addition, the dead space of the display device can be reduced.

The foregoing is illustrative of the inventive technology and is not to be construed as limiting thereof. Although a few exemplary embodiments have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. Therefore, it is to be understood that the foregoing is illustrative of the inventive concept and is not to be construed as limited to the specific exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. A display panel inspecting apparatus comprising:

a first inspecting circuit configured to alternately apply a first-color data signal and a second-color data signal to a first data line electrically connected to a first first-color subpixel and a first second-color subpixel;

a second inspecting circuit configured to apply a first third-color data signal to a second data line electrically connected to a first third-color subpixel and a second third-color subpixel;

a third inspecting circuit configured to alternately apply the second-color data signal and the first-color data signal to a third data line electrically connected to a second second-color subpixel and a second first-color subpixel; and a fourth inspecting circuit configured to apply a second third-color data signal from a different source than the first third-color data signal to a fourth data line electrically connected to a third third-color subpixel and a fourth third-color subpixel.

2. The display panel inspecting apparatus of claim 1, wherein the first inspecting circuit comprises first and second switching elements, wherein the first switching element comprises a control electrode electrically connected to a first gate pad, an input electrode electrically connected to a first data pad and an output electrode electrically connected to the first data line, and wherein the second switching element comprises a control electrode electrically connected to a second gate pad, an input electrode electrically connected to a second data pad and an output electrode electrically connected to the first data line.

3. The display panel inspecting apparatus of claim 2, wherein the third inspecting circuit comprises fourth and fifth switching elements, wherein the fourth switching element comprises a control electrode electrically connected to the first gate pad, an input electrode electrically connected to the second data pad and an output electrode electrically connected to the third data line, and wherein the fifth switching element comprises a control electrode electrically connected to the second gate pad, an input electrode electrically connected to the first data pad and an output electrode electrically connected to the third data line.

4. The display panel inspecting apparatus of claim 1, wherein the second inspecting circuit comprises a third switching element, and wherein the third switching element comprises a control electrode electrically connected to a third gate pad, an input electrode electrically connected to a third data pad and an output electrode electrically connected to the second data line.

5. The display panel inspecting apparatus of claim 4, wherein the fourth inspecting circuit comprises a sixth switching element, and wherein the sixth switching element comprises a control electrode electrically connected to the third gate pad, an input electrode electrically connected to a fourth data pad and an output electrode electrically connected to the fourth data line.

6. The display panel inspecting apparatus of claim 1, further comprising:

three gate pads each configured to turn on one or more of the first to fourth inspecting circuits; and four data pads each configured to supply a plurality of data signals respectively to the first to fourth data lines.

7. The display panel inspecting apparatus of claim 6, wherein the gate pads include first to third gate pads, wherein the data pads include first to fourth data pads, wherein the first and second gate pads are electrically connected to both of the first and third inspecting circuits, wherein the third gate pad is electrically connected to the second and fourth inspecting circuits, wherein the first and second data pads are electrically connected to both of the first and third inspecting circuits, wherein the third data pad is electrically connected to the second inspecting circuit, and wherein the fourth data pad is electrically connected to the fourth inspecting circuit.

8. The display panel inspecting apparatus of claim 6, further comprising a fifth inspecting circuit configured to apply the first third-color data signal to the fourth data line.

9. The display panel inspecting apparatus of claim 8, wherein the data pads include first to third data pads, wherein the gate pads include first to fourth gate pads, wherein the display panel inspecting apparatus further comprises first to third switching elements, wherein the second inspecting circuit comprises the third switching element, and wherein the third switching element comprises a control electrode electrically connected to the third gate pad, an input electrode electrically connected to the third data pad and an output electrode electrically connected to the second data line.

10. The display panel inspecting apparatus of claim 9, further comprising fourth to sixth switching elements, wherein the fourth inspecting circuit comprises the sixth switching element, and wherein the sixth switching element comprises a control electrode electrically connected to the fourth gate pad, an input electrode electrically connected to the fourth data pad and an output electrode electrically connected to the fourth data line.

11. The display panel inspecting apparatus of claim 10, further comprising a fifth gate pad, wherein the fifth inspecting circuit comprises a seventh switching element, and wherein the seventh switching element comprises a control electrode electrically connected to the fifth gate pad, an input electrode electrically connected to the third data pad and an output electrode electrically connected to the fourth data line.

12. A display device comprising:

a display panel comprising i) a first data line electrically connected to a first first-color subpixel and a first second-color subpixel, ii) a second data line electrically connected to a first third-color subpixel and a second third-color subpixel, iii) a third data line electrically connected to a second second-color subpixel and a second first-color subpixel and iv) a fourth data line electrically connected to a third third-color subpixel and a fourth third-color subpixel; and a display panel inspecting apparatus comprising i) a first inspecting circuit configured to alternately apply a first-color data signal and a second-color data signal to the first data line, ii) a second inspecting circuit configured to apply a first third-color data signal to the second data line, iii) a third inspecting circuit configured to alternately apply the second-color data signal and the first-color data signal to the third data line, and iv) a fourth inspecting circuit configured to apply a second third-color data signal from a different data source than the first third-color data signal to the fourth data line.

13. The display device of claim 12, wherein the first inspecting circuit comprises first and second switching elements, wherein the first switching element comprises a control electrode electrically connected to a first gate pad, an input electrode electrically connected to a first data pad and an output electrode electrically connected to the first data line, and wherein the second switching element comprises a control electrode electrically connected to a second gate pad, an input electrode electrically connected to a second data pad and an output electrode electrically connected to the first data line.

14. The display device of claim 13, wherein the third inspecting circuit comprises fourth and fifth switching elements, wherein the fourth switching element comprises a control electrode electrically connected to the first gate pad, an input electrode electrically connected to the second data pad and an output electrode electrically connected to the third data line, and wherein the fifth switching element comprises a control electrode electrically connected to the second gate pad, an input electrode electrically connected to the first data pad and an output electrode electrically connected to the third data line.

15. The display device of claim 12, wherein the second inspecting circuit comprises a third switching element, and wherein the third switching element comprises a control electrode electrically connected to a third gate pad, an input electrode electrically connected to a third data pad and an output electrode electrically connected to the second data line.

16. The display device of claim 15, wherein the fourth inspecting circuit comprises a sixth switching element, and wherein the sixth switching element comprises a control electrode electrically connected to the third gate pad, an input electrode electrically connected to a fourth data pad and an output electrode electrically connected to the fourth data line.

17. The display device of claim 12, wherein the display panel inspecting apparatus further comprises a fifth inspecting circuit configured to apply the first third-color data signal to the fourth data line.

18. The display device of claim 12, wherein the display panel comprises a subpixel group comprising:

a first red subpixel;

a first green subpixel adjacent to the first red subpixel in a first direction;

a second blue subpixel adjacent to the first green subpixel in the first direction;

a third green subpixel adjacent to the second blue subpixel in the first direction;

a first blue subpixel adjacent to the first red subpixel in a second direction crossing the first direction;

a second green subpixel adjacent to the first blue subpixel in the first direction;

a second red subpixel adjacent to the second green subpixel in the first direction; and a fourth green subpixel adjacent to the second red subpixel in the first direction, wherein the first red subpixel, the first green subpixel, the first blue subpixel and the second green subpixel form a first pixel, and wherein the second blue subpixel, the third green subpixel, the second red subpixel and the fourth green subpixel form a second pixel.

19. The display device of claim 12, further comprising a gate driver configured to apply a gate signal to the subpixels and a data driver configured to apply a grayscale voltage to the subpixels, wherein the display panel inspecting apparatus overlaps the data driver.

20. A method of inspecting a display panel comprising:

applying a first-color data signal and a second-color data signal to a first data line electrically connected to a first first-color subpixel and a first second-color subpixel, wherein the first-color data signal is applied via a first data pad and the second-color data signal is applied via a second data pad;

applying a first third-color data signal to a second data line electrically connected to a first third-color subpixel and a second third-color subpixel, wherein the first third-color data signal is applied via a third data pad;

applying the second-color data signal and the first-color data signal to a third data line electrically connected to a second second-color subpixel and a second first-color subpixel; and applying a second third-color data signal from a different source than the first third-color data signal to a fourth data line electrically connected to a third third-color subpixel and a fourth third-color subpixel, wherein the second third-color data signal is applied via a fourth data pad different from the third data pad.

* * * * *